US006804994B2

(12) United States Patent
Shimada

(10) Patent No.: US 6,804,994 B2
(45) Date of Patent: Oct. 19, 2004

(54) DYNAMIC LOADING SYSTEM, DYNAMIC LOADING METHOD AND DYNAMIC LOADING TEST METHOD FOR PILES

(75) Inventor: Takashi Shimada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/186,921

(22) Filed: Jul. 2, 2002

(65) Prior Publication Data

US 2003/0122434 A1 Jul. 3, 2003

(30) Foreign Application Priority Data

Dec. 27, 2001 (JP) ..... 2001-395525

(51) Int. Cl.[7] ..... G01N 3/38
(52) U.S. Cl. ..... 73/110.3
(58) Field of Search ..... 73/644, 662, 84, 73/11.03, 12.11, 12.12, 643, 82

(56) References Cited

U.S. PATENT DOCUMENTS 5,325,702 A * 7/1994 Verstraeten ..... 73/12.13
5,581,013 A * 12/1996 Frederick ..... 73/11.03
6,349,590 B1 * 2/2002 Wai ..... 73/84

FOREIGN PATENT DOCUMENTS

| | | | | |
|---|---|---|---|---|
| DE | 10028872 A1 | | 12/2001 | |
| EP | 1028314 A1 | | 8/2000 | |
| JP | 59161517 A | * | 9/1984 | ..... E02D/7/18 |
| JP | 59165730 A | * | 9/1984 | ..... E02D/7/18 |
| JP | 5-339932 | | 12/1993 | |
| JP | 09088110 A | | 3/1997 | |
| JP | 10153497 a | * | 6/1998 | ..... G01L/1/00 |
| JP | 10-1535004 | | 6/1998 | |

* cited by examiner

*Primary Examiner*—Hezron Williams
*Assistant Examiner*—Rose M. Miller
(74) *Attorney, Agent, or Firm*—Sughrue Mion, PLLC

(57) ABSTRACT

A magnetostrictive vibrator including a core made of a magnetostrictive material and an exciting coil wound on the core is connected to the head of a pile and an electric current is fed into the exciting coil. A strain occurring in the magnetostrictive vibrator is transmitted to produce vibrations in the pile, wherein the amplitude and frequency of the vibrations is controlled by controlling the electric current fed into the exciting coil. The bearing capacity of the pile is estimated by detecting vibrations transmitted to the ground around the pile. A dynamic loading test of the pile is conducted in this fashion with ease and good controllability at low cost without the need for complicated analytical treatment, yet allowing a reliable estimation of the bearing capacity of the pile.

11 Claims, 15 Drawing Sheets

DYNAMIC LOADING SYSTEM, DYNAMIC LOADING METHOD AND DYNAMIC LOADING TEST METHOD FOR PILES

BACKGROUND OF THE INVENTION

1. Field of the Invention

The present invention relates to a dynamic loading system for piles which serve as a foundation of a structure, a dynamic loading method for estimating the bearing capacity of a pile, and a dynamic loading test method.

2. Description of the Background Art

Soil under strain can be treated as an elastic body when the strain is equal to or smaller than $10^{-4}$, or in a region of $10^{-5}$ if the soil is relatively soft. When the soil is subjected to a strain exceeding these values, its plastic nature gains greater importance.

When a load exerted on a pile driven into the ground is small and strain occurring in the pile is remarkably small, strain occurring in the ground which is in contact with the pile is also remarkably small, so that the ground can be treated as an elastic body. In this case, the strain in both the pile and the ground is eliminated and they resume their original form when the load is removed. The load applied in this case falls within a range not exceeding their ultimate bearing capacity.

When the applied load is increased, the strain occurring in the pile increases, also causing a large amount of strain in the ground. When the plastic nature of the ground becomes of greater importance as a consequence, plastic deformation occurs in the ground which is in contact with the pile. The plastic deformation of the ground does not disappear and the pile does not return to its original position even when the load is removed. The load applied in this case falls within a range exceeding the ultimate bearing capacity.

Conventionally, stationary loading tests, dynamic loading tests and rapid loading tests are performed as methods for evaluating the ultimate bearing capacity (hereinafter referred to as the bearing capacity) of a pile.

The stationary loading test is a method of determining the stationary bearing capacity of a pile from the relationship between a load and the amount of sinking of the pile when the load is exerted on the pile to be tested.

FIG. 15 is a diagram showing the structure of a conventional stationary loading system 1000 for measuring the bearing capacity of a pile. In this Figure, designated by the numeral 1001 is a test pile whose bearing capacity is to be measured, designated by the numeral 1002 is one of reacting piles, designated by the numeral 1003 is a loading beam, designated by the numeral 1004 is a hydraulic jack, designated by the numeral 1005 is a control unit for controlling the hydraulic jack 1004, and designated by the numeral 1006 is a gauge. Further, the marking GL indicates the ground level.

The stationary loading test method carried out by the stationary loading system 1000 thus constructed is described in the following. As shown in the Figure, the reacting piles 1002 are provided around the test pile 1001 to be tested. While supporting a loaded weight with the reacting piles 1002, a load is applied to the test pile 1001. This load is applied by the hydraulic jack 1004 which is provided between the loading beam 1003 supported by the reacting piles 1002 and the test pile 1001. The hydraulic jack 1004 applies the load to the test pile 1001 in a vertical direction according to a control quantity fed from the control unit 1005. After loading, the amount of sinking of the test pile 1001 is measured by the gage 1006 and the bearing capacity is assessed from the relationship between the amount of the loaded weight and the amount of sinking.

Although the bearing capacity of a test pile can be measured with high reliability by this kind of conventional stationary loading test method, it necessitates considerably large-scale work, such as driving the reacting piles and installing the loading beam for producing a sufficient load to be applied to the test pile, involving the provision of a sizable testing facility. In addition, movement of the facility requires considerable expenses and time, resulting in extremely poor efficiency. It has therefore been difficult in practice to measure the bearing capacities of a large number of piles.

In a conventional dynamic loading test method, on the other hand, a load is dynamically exerted on a test pile by hammering its head and the bearing capacity of the test pile is estimated by analyzing a response obtained by a vibration sensor mounted on the pile head.

Although this kind of dynamic loading test method does not require a large-scale facility like that of the stationary loading test method, loading time is as short as a few milliseconds and the wavelength of elastic vibrations produced is sufficiently short compared to the length of the test pile. Therefore, it is necessary to carry out a complicated analytical treatment based on a wave theory by regarding the pile body as a one-dimensional elastic body in a stage of estimating the bearing capacity from waveforms detected by the vibration sensor. In addition, estimated values of the bearing capacity fluctuate to a large extent because information obtained from the pile head is limited.

In a conventional rapid loading test method, a load is exerted on a test pile by exploding a propellant like an explosive and applying a resultant impact force to the pile head. In this method, it is possible to obtain about ten times as longer a loading time as in the conventional dynamic loading test method and apply the load in a more stationary state. This method has problems in practical applications, however, because it involves a lot of limitations including the need for careful handling of the explosive.

Another conventional dynamic loading test method disclosed in Japanese Laid-open Patent Publication No. 10-153504 is described in the following with reference to FIG. 16 as an example of a method intended to overcome the problems of the aforementioned dynamic loading test method.

In hammering a pile head by dynamic loading of this test method, a load is exerted at a desired frequency by successively dropping a plurality of split hammer blocks at regular intervals.

In a stationary loading system shown in FIG. 16, a guide shaft 2002 is installed upright on an anvil 2001 and a hook 2003 is provided at the top of the guide shaft 2002. The anvil 2001 has at its lower portion a pile cap 2004 which is fitted over the head of a pile P. Measuring equipment, such as a load meter 2005, is provided between the anvil 2001 and the pile head for measuring the load and a displacement meter 2006 is provided on a side surface of the pile cap 2004 for measuring the displacement of the pile head. A hammer includes a plurality of hammer blocks M1–Mn, each hammer block M having a through hole 2007 at a central position for passing the guide shaft 2002.

Next, operation of this stationary loading system is described below.

The hammer blocks M mounted on the guide shaft 2002 are hung by wire ropes 2008 which are hooked on the hook

2003. Each wire rope 2008 is equipped with an unillustrated latch and the hammer blocks M are retained at regular intervals d. The hammer blocks M are simultaneously released by disengaging the hook 2003. As a result, the individual hammer blocks M fall successively onto the pile head striking against it and exerting a series of loads thereupon. The loads are measured by the load meter 2005 and the displacement of the pile head is determined by the displacement meter 2006.

In the aforementioned loading method, the regular spacing d between the successive hammer blocks M defines uniform time intervals between them, so that dropping time intervals can be varied by altering the spacing d. Thus, this method makes it possible to control the frequency of the entire loads and apply the loads in a state much closer to stationary conditions.

Even by the aforementioned improved dynamic loading test method the prior art, however, it is difficult to continually apply loads for an extended period of time. In addition, it is necessary to adjust the spacing between hammer blocks for controlling the frequency of the loads and to adjust the mass of the hammer blocks for controlling impact forces produced when the successive hammer blocks strike against the pile head, relusting in complicated work and poor efficiency.

SUMMARY OF THE INVENTION

This invention is intended to provide means for overcoming the aforementioned problems of the prior art. Specifically, it is an object of the invention to provide a dynamic loading method and a dynamic loading test method which make it possible to conduct a loading test of a pile with good controllability and ease at low cost and to estimate the bearing capacity of the pile with high reliability without the need for complicated analytical treatment. It is another object of the invention to provide a structure of a dynamic loading system which enables such dynamic loading.

According to the invention, a dynamic loading system for a pile includes a magnetostrictive vibrator formed of a magnetostrictive element which becomes strained when placed in a magnetic field and an exciting coil for producing the magnetic field in the magnetostrictive element. Further including a joint mechanism for connecting the magnetostrictive vibrator to the head of the pile, a power supply unit for feeding an electric current into the magnetostrictive vibrator and a control unit for controlling the frequency and amplitude of the electric current, the dynamic loading system vibrates the pile by a strain occurring in the magnetostrictive vibrator.

This dynamic loading system of the invention makes it possible to control vibrations produced in the pile in a desired fashion with a simple and low-cost system configuration. It also makes it possible to efficiently perform dynamic loading and dynamic loading tests with high reliability.

According to the invention, a dynamic loading method for a pile includes feeding an electric current into an exciting coil of a magnetostrictive vibrator which is connected to the head of the pile, and transmitting a strain occurring in the magnetostrictive vibrator due to a magnetic field to the pile in the form of vibrations to thereby vibrate the pile.

This method makes it possible to perform dynamic loading and a dynamic loading test with high reliability, in which vibrations produced in the pile can be controlled in a desired fashion.

According to the invention, a dynamic loading test method for a pile includes vibrating the pile by the aforementioned dynamic loading method, detecting vibrations produced in the ground around the pile, and estimating the bearing capacity of the pile.

This method makes it possible to conduct a loading test of the pile with good controllability and ease at low cost and estimate the bearing capacity of the pile with high reliability without the need for complicated analytical treatment.

In another dynamic loading test method for a pile, the pile is vibrated by feeding an electric current whose amplitude varies with time into the exciting coil of the magnetostrictive vibrator using the aforementioned dynamic loading method. Then, vibrations produced in the pile itself and in the ground around the pile are detected by respective vibration sensors, and the bearing capacity of the pile is estimated by calculating a transfer function from sensing signals of the respective vibration sensors.

This method makes it possible to conduct a loading test of the pile with good controllability and ease at low cost and estimate the bearing capacity of the pile with high reliability and certainty by estimating individual parameters of a theoretical model applied to a contact surface between a peripheral surface of the pile and the ground without the need for complicated analytical treatment.

Still another dynamic loading test method for a pile includes first to fifth steps which are described in the following. The first step determines the bearing capacity of a reference pile driven into the ground in the vicinity of the pile by a stationary loading test method. In the second step, the reference pile is vibrated by the aforementioned dynamic loading method and vibrations produced in the ground around the reference pile are detected. In the third step, the bearing capacity of the reference pile obtained in the first step and a vibration sensing signal obtained in the second step are memorized together with information on their mutual relationship. In the fourth step, the pile is vibrated in the same way as the second step and vibrations produced in the ground are detected. In the fifth step, the bearing capacity of the pile is estimated based on a vibration sensing signal obtained in the fourth step with reference to information memorized in the third step.

This method makes it possible to conduct a loading test of the pile with good controllability and ease at low cost and estimate the bearing capacity of the pile with ease and high reliability without being adversely affected by stratum formation or the ground.

These and other objects, features and advantages of the invention will be more apparently understood from the following detailed description if read in conjunction with the accompanying drawings.

DESCRIPTION OF THE PREFERRED EMBODIMENTS

First Embodiment

A first embodiment of the invention is now described with reference to FIGS. 1 and 2.

Figure 1:
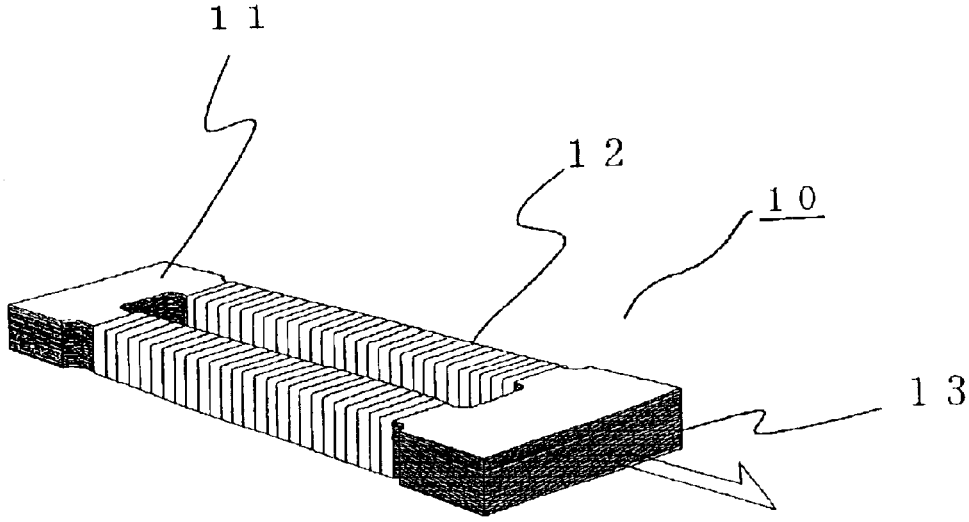
FIG. 1 is a diagram showing the structure of a magnetostrictive vibrator according to a first embodiment of the invention.
Figure 2:
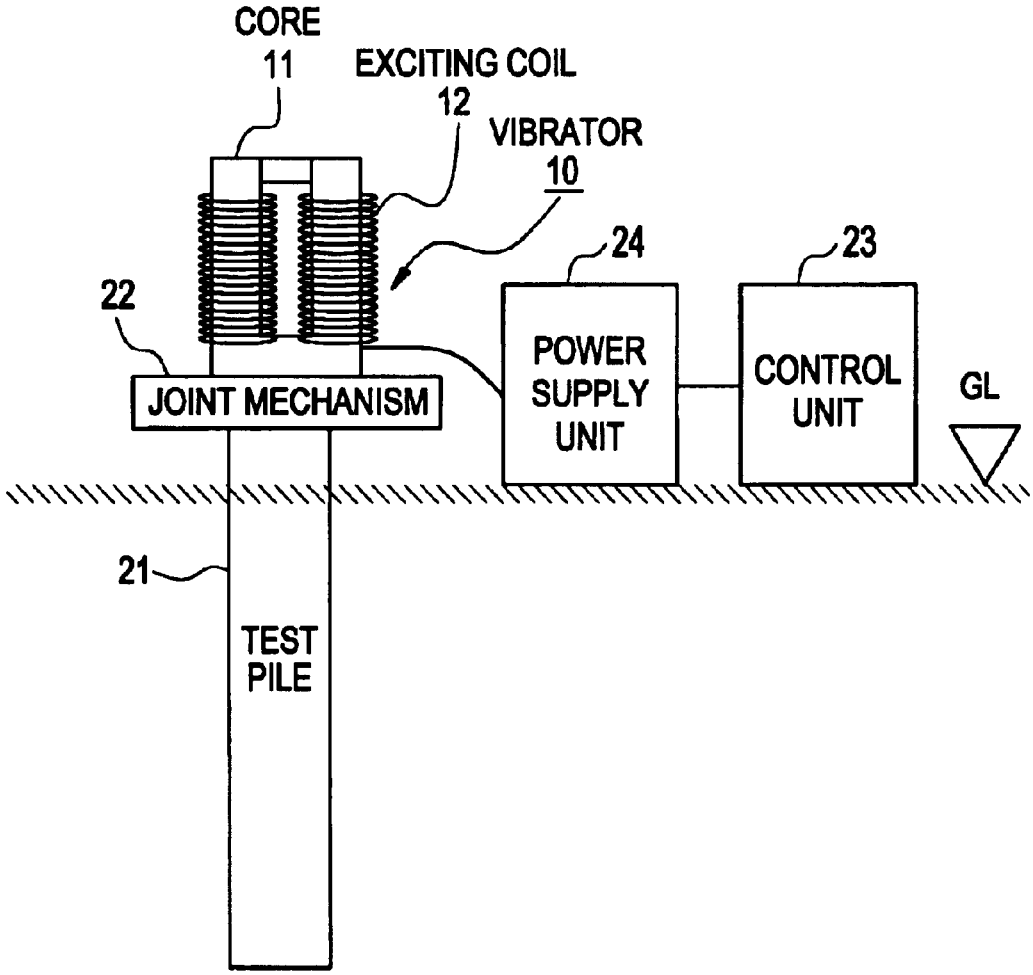
FIG. 2 is a diagram showing the structure of a dynamic loading system employing the magnetostrictive vibrator of the first embodiment.

FIG. 1 is a diagram showing the structure of a magnetostrictive vibrator according to the first embodiment of the invention, and FIG. 2 is a diagram showing the structure of a dynamic loading system for a pile employing the magnetostrictive vibrator shown in FIG. 1.

In these Figures, designated by the numeral 10 is the aforementioned magnetostrictive vibrator which includes a core 11 produced by shaping a magnetostrictive material and an exciting coil 12. The numeral 13 indicates an end surface of the exciting coil 12. Designated by the numeral 21 is a test pile, designated by the numeral 22 is a joint mechanism for connecting the magnetostrictive vibrator 10 to the head of the test pile 21, designated by the numeral 23 is a control unit for controlling an electric current supplied to the exciting coil 12, and designated by the numeral 24 is a power supply unit. Further, the marking GL indicates the ground level.

The magnetostrictive material has such a property that it deforms by an amount determined by an external magnetic field in a direction of a magnetic flux at a response time of a few tens of microseconds or less. Among metallic magnetostrictive materials, there exist such high-strength materials that have a Young's modulus comparable to that of steel. It is therefore possible to obtain a power source which exhibits sufficient durability even when a large external force is applied.

As shown in FIG. 1, the magnetostrictive vibrator 10 is made by winding the exciting coil 12 having a toroidal shape on the core 11 which is produced by forming the magnetostrictive material into a π-shape or a rectangular shape. When a current flows through the exciting coil 12, a magnetic field is produced by induction in a direction intersecting the direction of the current and the core 11 deforms in the direction of the magnetic flux. When the amplitude or frequency of the current is varied, a strain corresponding to their variations occurs in the core 11. Thus, if the end surface 13 of the core 11 is forced in the direction of an arrow against an object to be tested, the strain occurring in the core 11 is transferred to the object in the form of vibrations.

As shown in FIG. 2, the core 11 on which the exciting coil 12 is wound is connected to the test pile 21 via the joint mechanism 22. On the other hand, the control unit 23 outputs a signal for controlling an output current to the power supply unit 24, and the power supply unit 24 varies the amplitude or frequency of its output current according to this control signal. The output current of the power supply unit 24 is fed into the exciting coil 12, producing a strain corresponding to the amplitude or frequency of the output current in the magnetostrictive vibrator 10. This strain occurring in the magnetostrictive vibrator 10 is transferred to the test pile 21 in the form of vibrations, causing vibrations in the test pile 21. This means that the vibrations occurring in the test pile 21 are controllable in a desired fashion. It is to be noted that the core 11 produced by shaping the magnetostrictive material is designed in such a manner that it would satisfy such conditions as a required vibrating frequency range and vibrating amplitude as well as necessary load withstand capacity according to the diameter and length of the test pile 21 and the scale of dynamic loading tests being planned.

According to this embodiment, the test pile 21 is vibrated by feeding an electric current into the exciting coil 12 of the magnetostrictive vibrator 10 and transferring the strain occurring in the magnetostrictive vibrator 10 to the test pile 21 in the form of vibrations, whereby a load is exerted on the test pile 21. The duration of application, frequency and amplitude of the electric current fed into the exciting coil 12 can be controlled in a desired fashion by the control unit 23. Thus, the vibrations occurring in the test pile 21 is controllable in a desired fashion and, therefore, the frequency and amount of the load applied to the test pile 21 can be easily controlled.

Furthermore, by using the magnetostrictive vibrator 10, it is possible to provide a dynamic loading system of a simple structure which can easily control the frequency and amount of the load applied to the test pile 21 at low cost. Moreover, by proper design of the joint mechanism 22, it is possible to easily move the system and perform highly reliable dynamic loading and dynamic loading tests with high efficiency.

Second Embodiment

Figure 3:
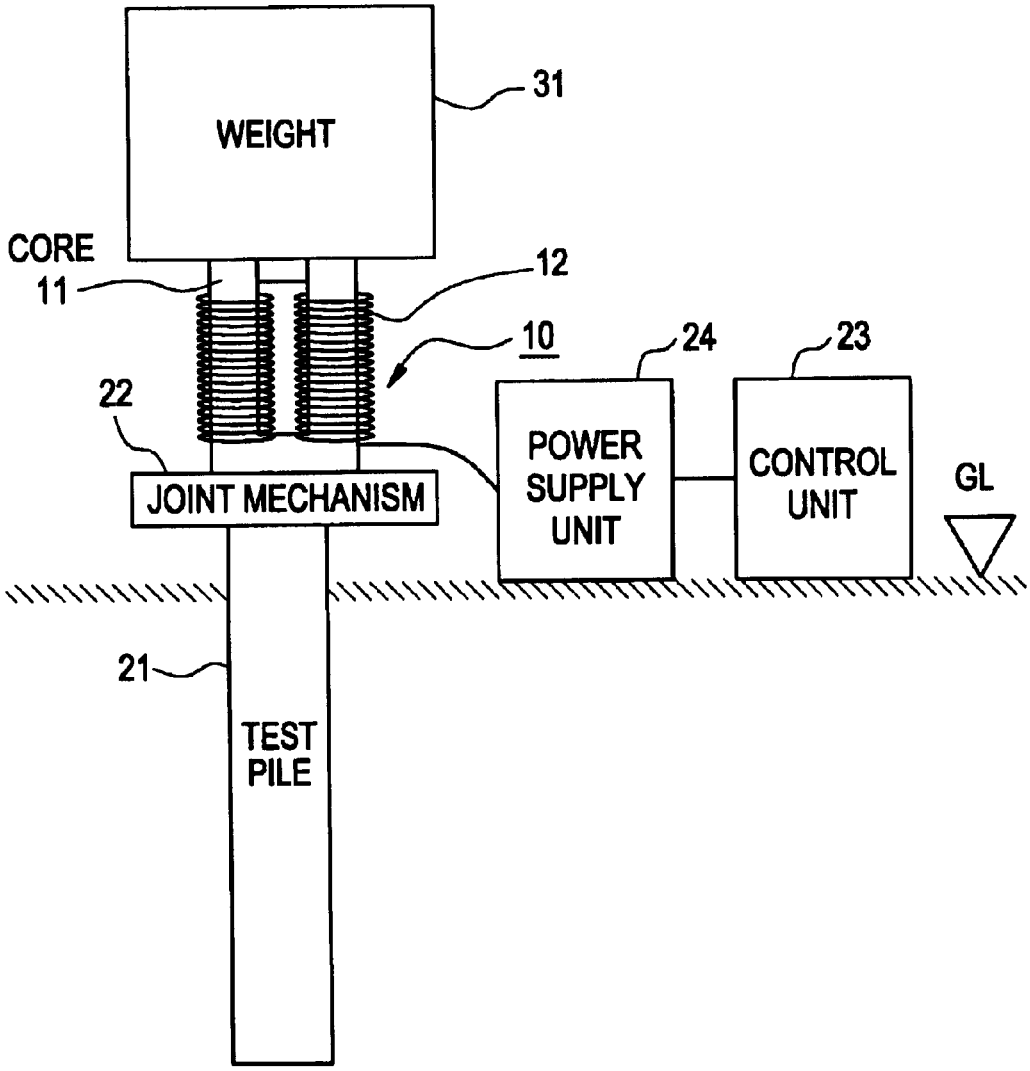
FIG. 3 is a diagram showing the structure of a dynamic loading system according to a second embodiment of the invention.

FIG. 3 is a diagram showing the structure of a dynamic loading system for a pile according to a second embodiment of the invention. As shown in the Figure, there is provided a weight 31 of a specific mass on top of the magnetostrictive vibrator 10 of the dynamic loading system according to the aforementioned first embodiment such that the magnetostrictive vibrator 10 supports the weight 31.

When causing vibrations in an object under test, it is possible to produce an amplitude multiplied by a magnification factor which is determined by a Q value of resonance at a resonant frequency and to efficiently produce vibrations of a large amplitude at frequencies centering on the resonant frequency.

The resonant frequency Fs of the magnetostrictive vibrator 10 is given by the following equation:

$$Fs=V/(2Ls)$$

where Ls is the effective length of the magnetostrictive vibrator 10 and V is the propagation velocity of sound in metal.

Generally, the propagation velocity of sound in metal is 5000 m/s and, therefore, if Ls=2 m, for example, the resonant frequency Fs is 1250 Hz. While the magnetostrictive vibrator 10 itself efficiently produces vibrations of a large amplitude at the resonant frequency Fs, it is impossible to efficiently transfer these vibrations to a test pile 21 to vibrate it as the test pile 21 is far longer than the magnetostrictive vibrator 10.

In this embodiment, the magnetostrictive vibrator 10 supports the weight 31 of the specific mass. Since the wavelength of vibrations at the resonant frequency of the magnetostrictive vibrator 10 carrying the weight 31 is increased to an extent comparable to the length of the test pile 21, it is possible to efficiently cause large vibrations in the test pile 21.

The resonant frequency F0 of the magnetostrictive vibrator 10 carrying the weight 31 is determined by the mass M of the weight 31 and the stiffness Km of the magnetostrictive vibrator 10 and given by the following equation:

$$F0=(Km/M)^{1/2}/2\pi$$

where

Km=E·S/L

E=Young's modulus of the magnetostrictive vibrator 10

S=cross-sectional area of the magnetostrictive vibrator 10

L=effective length of the magnetostrictive vibrator 10

If the Young's modulus, the cross-sectional area and effective length of the magnetostrictive vibrator 10 and the mass of the weight 31 are $E=21\cdot10^{10}$ ($N\cdot m^{-2}$), S=7200 $mm^2$, L=2 m, M=3000 kg, respectively, for example, the resonant frequency F0=80 Hz and the wavelength is approximately 20 m which is comparable to the length of the test pile 21.

Since this embodiment employs the structure in which the magnetostrictive vibrator 10 of the dynamic loading system supports the weight 31, it is possible to increase the wavelength of vibrations of the magnetostrictive vibrator 10 at its resonant frequency to an extent comparable to the length of the test pile 21 and thereby produce large vibrations in the test pile 21. For this reason, it is possible to reduce the necessary capacity and scale of a power source and realize a simple and low-cost dynamic loading system.

Third Embodiment

Figure 4:
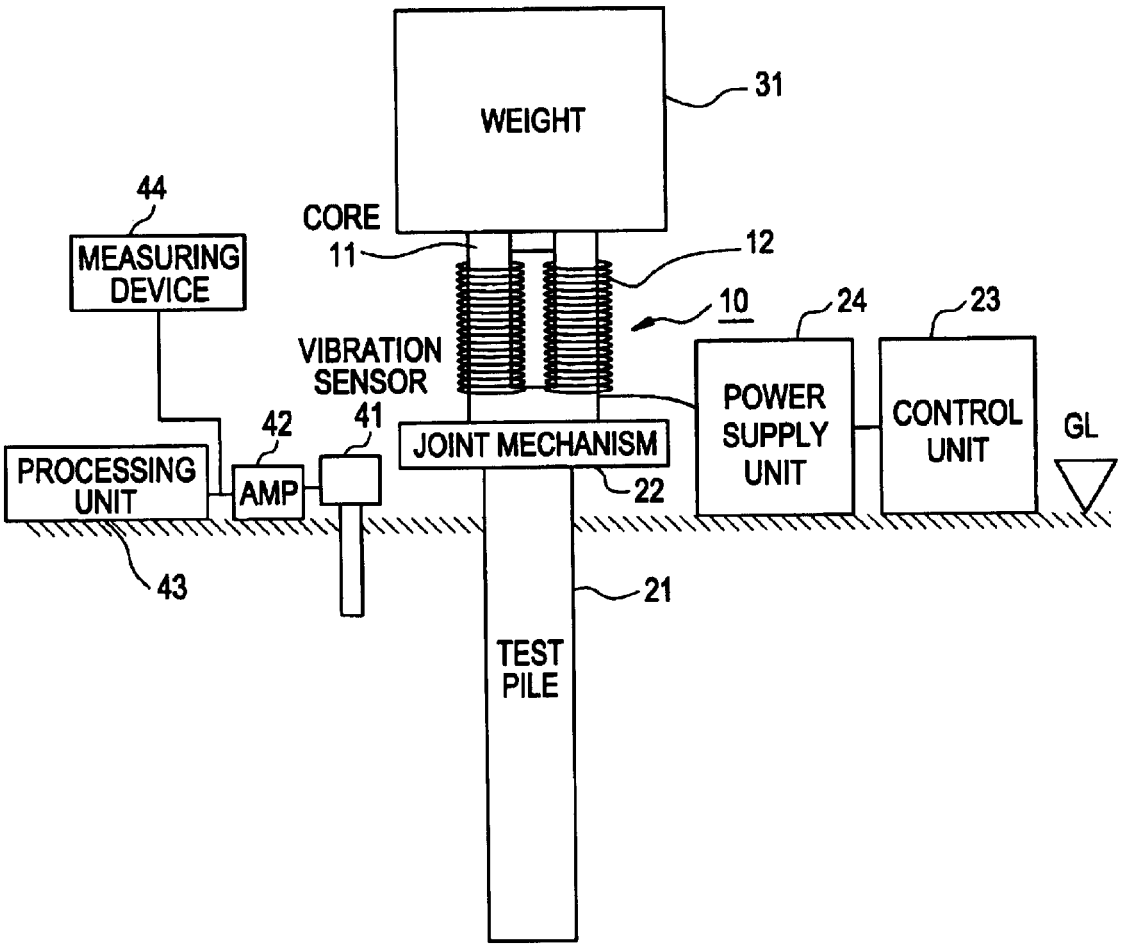
FIG. 4 is a diagram illustrating a dynamic loading test method according to a third embodiment of the invention.

A dynamic loading test method for estimating the bearing capacity of a test pile 21 using the dynamic loading system of the second embodiment is now described referring to FIG. 4.

As shown in FIG. 4, the control unit 23 delivers a specific control signal to the power supply unit 24, and the power supply unit 24 supplies an electric current into the exciting coil 12 in accordance with the control signal. As a result, vibrations of a specific frequency and amplitude occur in the magnetostrictive vibrator 10 due to its distortion, and the vibrations are transmitted to the head of the test pile 21 via the joint mechanism 22, causing vibrations in the test pile 21. The vibrations transmitted to the test pile 21 further propagate from its peripheral surface into the surrounding ground and are detected by a vibration sensor 41 mounted on the ground. The vibration sensor 41 converts the detected vibrations into an electric signal, which is input into the an amplifier 42. After appropriate amplification of this input signal by the amplifier 42, the signal is delivered to a mathematical processing unit 43, in which the input signal is subjected to a filtering process for eliminating extraneous noise which could mix with the signal during detection of the vibrations followed by a digital conversion process, and the amplitude of the vibrations is determined by a specific mathematical operation. Alternatively, the output signal of the amplifier 42 may be entered directly into a measuring device 44 like an oscilloscope, which also enables determination of the amplitude.

When a restraining force exerted on the peripheral surface of a pile by the surrounding ground is large, the efficiency of vibration transmission from the pile to the ground increases. When the restraining force is small on the contrary, the efficiency of vibration transmission from the pile to the ground decreases. Therefore, if a reference vibration of a specific frequency and amplitude is produced in the test pile 21 by using the magnetostrictive vibrator 10 and resultant vibrations of the ground are measured by the reference vibration sensor 41 mounted at a fixed point on the ground around the test pile 21, it is possible to determine the value of the amplitude of the vibration, which is proportional to the restraining force exerted on the peripheral surface of the test pile 21.

Subsequently, maximum stationary peripheral surface friction force which is an important parameter for determining the bearing capacity of a pile is calculated from the value of the amplitude thus obtained and the bearing capacity of the test pile 21 is determined. The maximum stationary peripheral surface friction force and its calculation method are described in the following.

Figure 5:
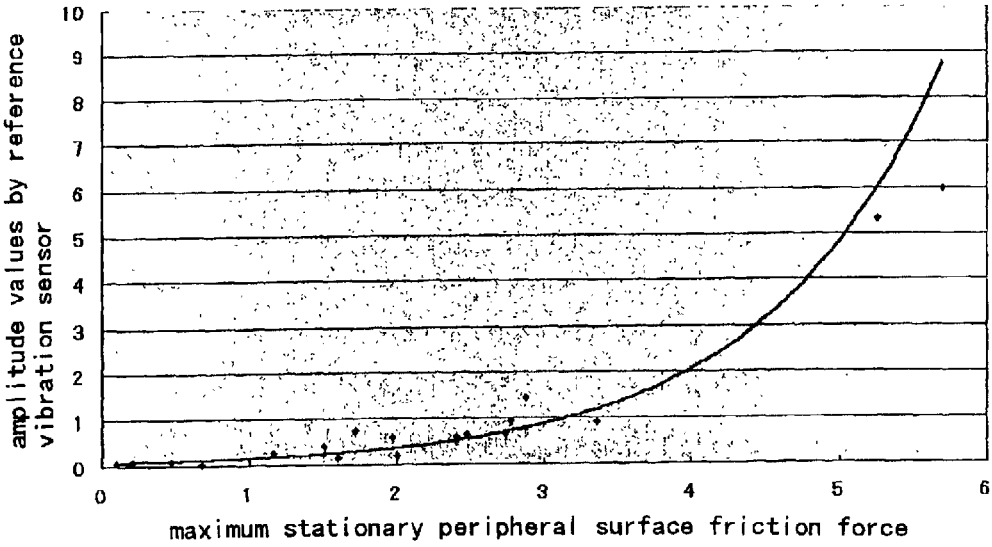
FIG. 5 is a diagram showing characteristics of maximum stationary peripheral surface friction force according to the third embodiment of the invention.

The maximum stationary peripheral surface friction force produced on the peripheral surface of a pile is proportional to the restraining force exerted by the ground on the peripheral surface of the pile, and an upper limit of strain occurring in the pile, below which the ground can be treated as an elastic body, rises with an increase in the maximum stationary peripheral surface friction force. Accordingly, an upper limit value of an applied load which causes the strain also rises and the bearing capacity of the pile increases with an increase in the maximum stationary peripheral surface friction force. Amplitude values of vibrations obtained by producing the reference vibration of the specific frequency and amplitude in a model of a pile and detecting resultant vibrations of the ground at the fixed point on the ground have a particular relationship with the maximum stationary peripheral surface friction force as shown in FIG. 5. Thus, the maximum stationary peripheral surface friction force of the test pile 21 is derived from amplitude values of vibrations which are obtained by determining the relationship between the amplitude value and the maximum stationary peripheral surface friction force beforehand based on field data, for instance, causing the reference vibration in the test pile 21 in the same way referring to the data, and detecting resultant vibrations of the ground by the reference vibration sensor 41.

Feeding the electric current into the exciting coil 12 of the magnetostrictive vibrator 10 in accordance with the specific control signal in the aforementioned manner, it is possible to easily control the frequency and amplitude of the load applied to the test pile 21, produce the reference vibration with good controllability, and calculate the maximum stationary peripheral surface friction force from the amplitude values obtained by detecting the vibrations of the ground. It is therefore possible to conduct a loading test of the test pile 21 with good controllability and ease at low cost and estimate the bearing capacity of the test pile 21 with high reliability without the need for complicated analytical treatment.

Fourth Embodiment

Figure 6:
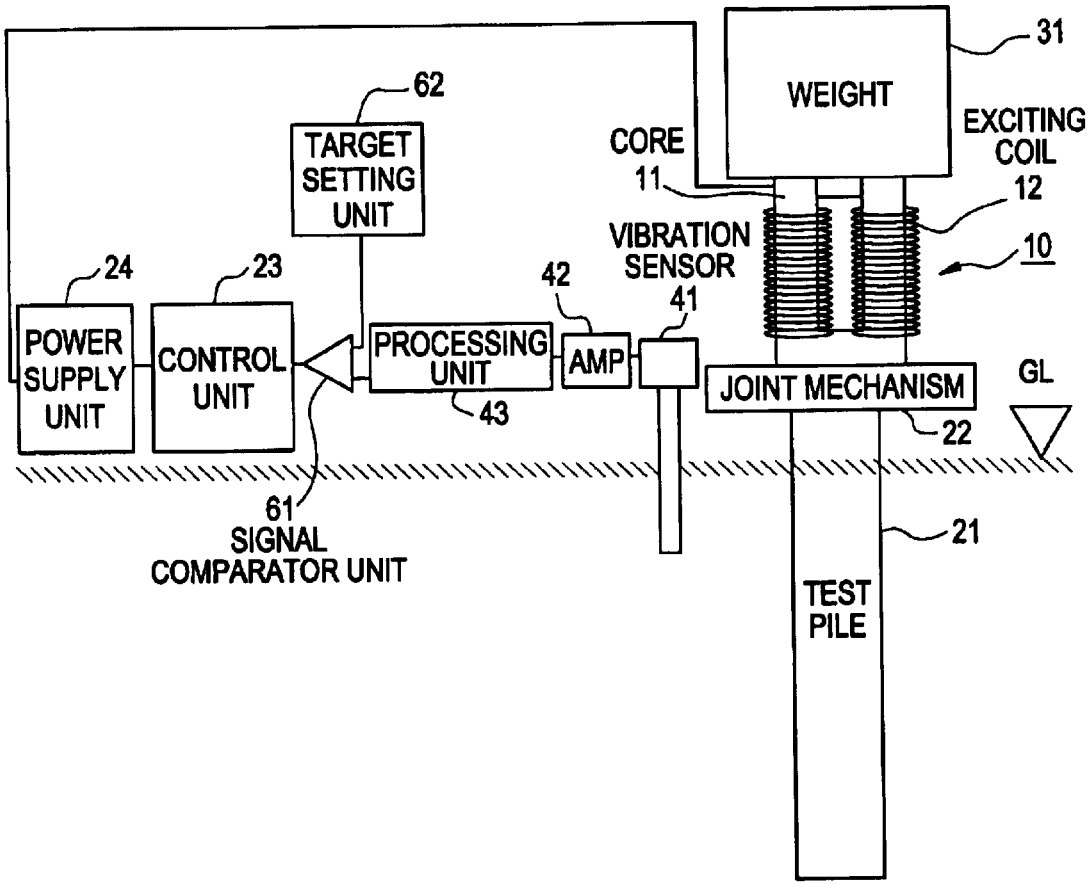
FIG. 6 is a diagram illustrating a dynamic loading test method according to a fourth embodiment of the invention.

A dynamic loading test method according to a fourth embodiment of the invention is now described referring to FIG. 6.

As shown in FIG. 6, the power supply unit 24 supplies an electric current into the exciting coil 12 in accordance with a control signal fed from the control unit 23, causing vibrations in the magnetostrictive vibrator 10 due to its strain. These vibrations are transmitted to the head of the test pile 21 via the joint mechanism 22, causing vibrations in the test pile 21. The vibrations transmitted to the test pile 21 further propagate from its peripheral surface into the surrounding ground and are detected by a vibration sensor 41 mounted on the ground. The vibration sensor 41 converts the detected vibrations into an electric signal, which is input into the an amplifier 42. After appropriate amplification of this input signal by the amplifier 42, the signal is delivered to a mathematical processing unit 43, which determines the amplitude of the vibrations by a specific mathematical operation. Subsequently, a signal comparator unit 61 compares a target value set in a target setting unit 62 and the amplitude determined by the mathematical processing unit 43 and outputs a control signal to the control unit 23 so that the amplitude matches the target value. Specifically, when the detected amplitude is smaller than the target value, the amplitude of the exciting current fed from the power supply unit 24 into the exciting coil 12 is increased, and when the detected amplitude is larger than the target value, the amplitude of the exciting current is decreased, in order to obtain a constant amplitude through feedback control.

In this loading test method, the amplitude of the exciting current is controlled such that the amplitude of the vibrations detected the vibration sensor 41 mounted on the ground becomes constant, and the value of the exciting current output from the power supply unit 24 is detected by a detector. The system is in a state in which the efficiency of vibration transmission from the test pile 21 to the ground is poor when the value of the exciting current is large, whereas the system is in a state in which the efficiency of vibration transmission from the test pile 21 to the ground is good when the value of the exciting current is small. Thus, if the relationship between the value of the exciting current and the maximum stationary peripheral surface friction force is determined beforehand, it is possible to easily obtain the maximum stationary peripheral surface friction force of the test pile 21 from the detected value of the exciting current.

It is therefore possible to conduct a loading test of the test pile 21 with good controllability and ease at low cost and estimate the bearing capacity of the test pile 21 with high reliability without the need for complicated analytical treatment in the same fashion as in the foregoing third embodiment.

While the value of the exciting current output from the power supply unit 24 is detected by the detector in the present embodiment, the value of the exciting current may be determined by detecting an amplitude control value contained in the control signal output from the control unit 23.

Furthermore, although the aforementioned third and fourth embodiments employ the dynamic loading system of the second embodiment, it is possible to estimate the bearing capacity with high reliability by using the dynamic loading system of the earlier-described first embodiment as well.

Fifth Embodiment

Figure 7:
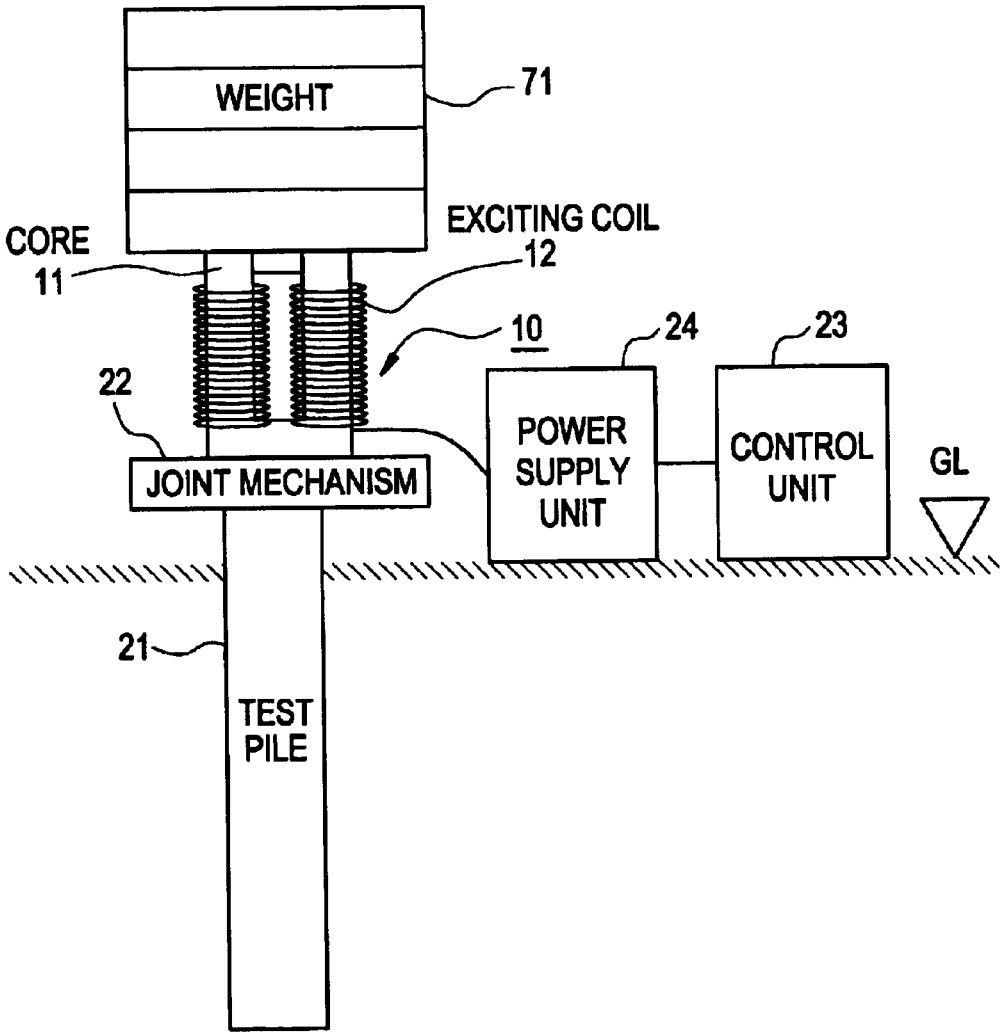
FIG. 7 is a diagram illustrating a dynamic loading method according to a fifth embodiment of the invention.

A dynamic loading method according to a fifth embodiment of the invention is now described referring to FIG. 7.

The dynamic loading system described in the foregoing second embodiment has the structure in which the weight 31 is supported by the magnetostrictive vibrator 10 and the wavelength of vibrations of the magnetostrictive vibrator 10 at its resonant frequency is increased to an extent comparable to the length of the test pile 21 to efficiently produce large vibrations in the test pile 21.

In the present embodiment, a weight 71 is constructed of a plurality of weight segments, as if the weight 31 of the dynamic loading system of the second embodiment is divided, so that the total mass of the weight 71 can be adjusted by freely varying the number of the weight segments. The resonant frequency of the magnetostrictive vibrator 10 carrying the weight 71 is matched to the resonant frequency of the test pile 21 by adjusting the mass of the weight 71.

The resonant frequency F0 of the magnetostrictive vibrator 10 carrying the weight 71 is determined by the mass M of the weight 71 and the stiffness Km of the magnetostrictive vibrator 10, and given by the following equation:

$$F0=(Km/M)^{1/2}/2\pi$$

where

Km=E·S/L

E=Young's modulus of the magnetostrictive vibrator 10

S=cross-sectional area of the magnetostrictive vibrator 10, and

L=effective length of the magnetostrictive vibrator 10.

Given the length L1 of the test pile 21 and the sound propagation velocity V of elastic waves propagating through the test pile 21, the resonant frequency F0 of longitudinal, or lengthwise, vibration of the test pile 21 is calculated by the following equation:

$$F1=V/(2L1)$$

From these equations, the mass M of the weight 71 for matching the resonant frequency of the magnetostrictive vibrator 10 carrying the weight 71 to the resonant frequency of the test pile 21 is determined by the following equation:

$$M=Km/(2\pi\cdot F1)^2$$

It is possible to easily match the resonant frequency of the magnetostrictive vibrator 10 carrying the weight 71 to the resonant frequency of the test pile 21 by setting the mass M of the weight 71 in the above-described manner. It is then possible to produce large vibrations with increased efficiency and good controllability by controlling the exciting current output from the power supply unit 24 so that the test pile 21 is vibrated at the aforementioned matched resonant frequency or at a frequency close to the resonant frequency. It is therefore possible to achieve reductions in size and weight and simplification of the dynamic loading system.

It is possible to conduct a dynamic loading test of the test pile 21 more efficiently if the dynamic loading test is carried out by applying the dynamic loading method described in this fifth embodiment to the aforementioned third or fourth embodiment. More specifically, the resonant frequency of the magnetostrictive vibrator 10 carrying the weight 71 is matched to the resonant frequency of the test pile 21 by setting the mass M of the weight 71 to a specific value and, then, the dynamic loading test is conducted by vibrating the test pile 21 at this resonant frequency.

Sixth Embodiment

While the mass M of the weight 71 is set such that the resonant frequency of the magnetostrictive vibrator 10 carrying the weight 71 matches the resonant frequency of the test pile 21 in the aforementioned fifth embodiment, it is necessary to determine the resonant frequency of the test pile 21 beforehand.

In the present embodiment, a method of determining the resonant frequency of the test pile 21 by actually vibrating the test pile 21 is described below with reference to FIG. 8.

Figure 8:
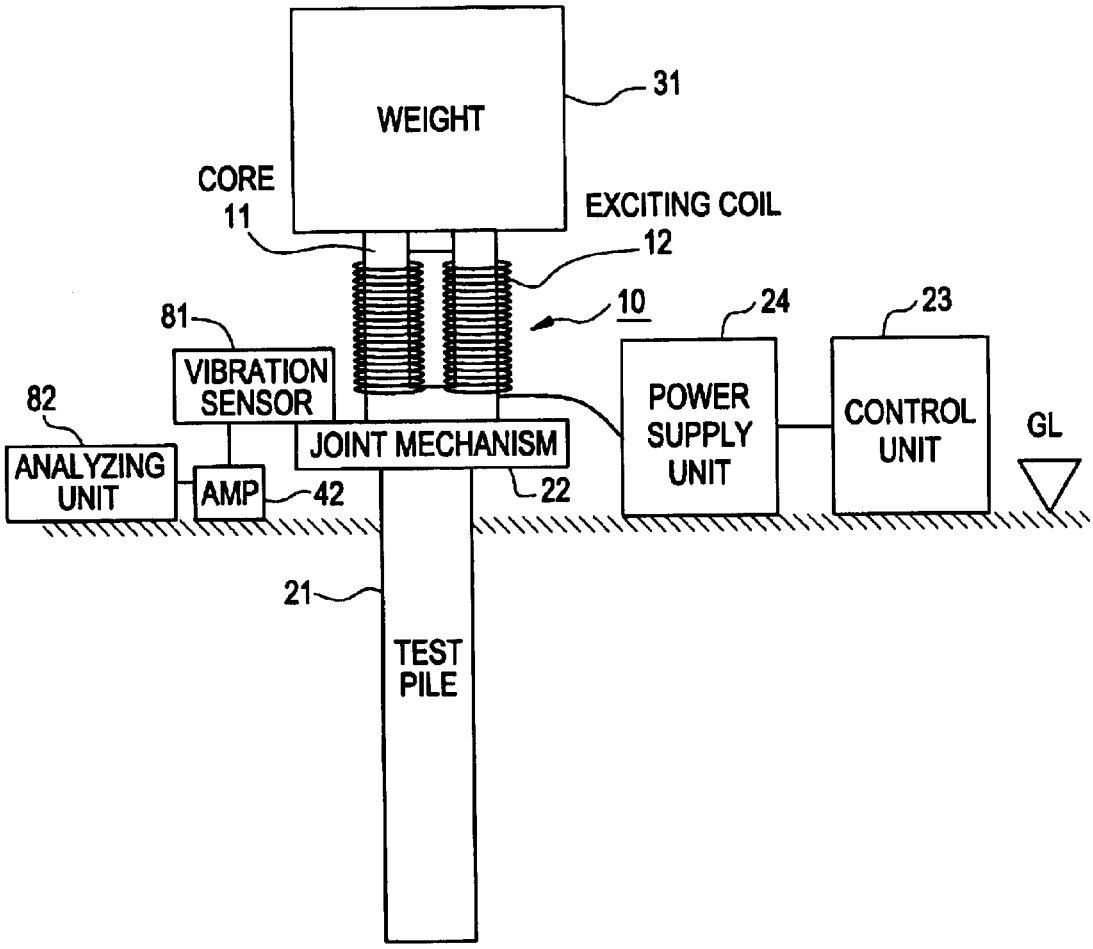
FIG. 8 is a diagram illustrating a method of determining a resonant frequency according to a sixth embodiment of the invention.

As shown in FIG. 8, the power supply unit 24 supplies an electric current into the exciting coil 12 in accordance with the control signal fed from the control unit 23, wherein the amplitude of the exciting current is fixed and its frequency is varied with time. As a result, vibrations occur in the magnetostrictive vibrator 10 due to its distortion, and the vibrations are transmitted to the head of the test pile 21 via the joint mechanism 22, causing vibrations in the test pile 21. The vibrations transmitted to the test pile 21 are detected by a vibration sensor 81 mounted on the head of the test pile 21. The vibration sensor 81 converts the detected vibrations into an electric signal, which is input into the an amplifier 42. After appropriate amplification by the amplifier 42, the signal is input into a frequency analyzing unit 82. In the frequency analyzing unit 82 the signal is subjected to a filtering process for eliminating extraneous noise which could mix with the signal during detection of the vibrations, followed by a digital conversion process and a Fourier transform process, and a frequency at which the amplitude of the vibrations in the test pile 21 is maximized is determined.

Figure 9:
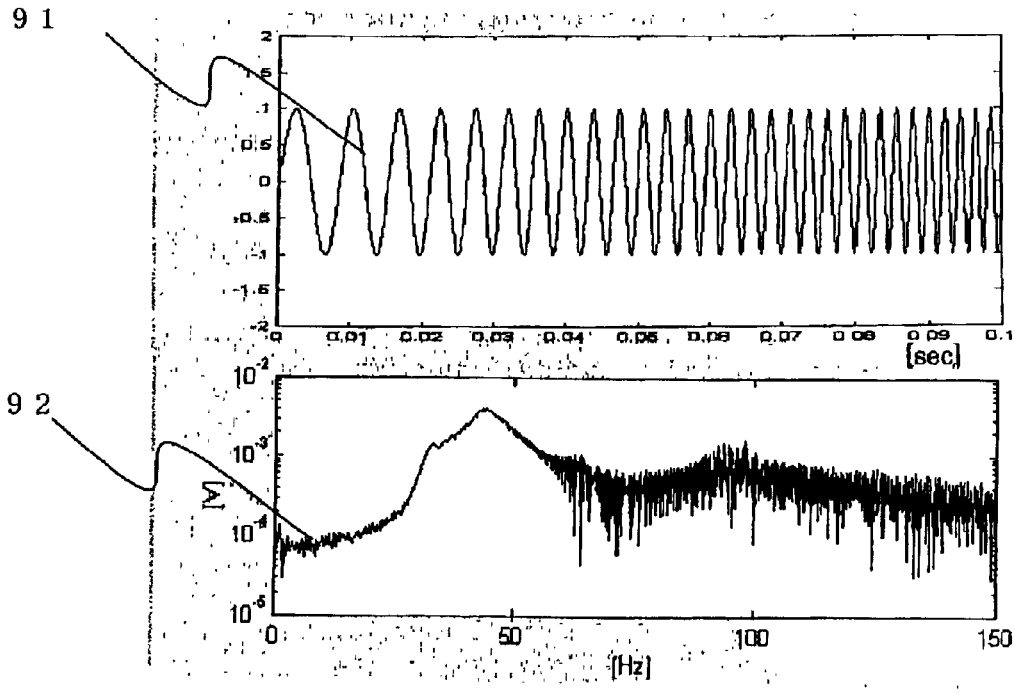
FIG. 9 is a diagram illustrating the method of determining the resonant frequency according to the sixth embodiment of the invention.

FIG. 9 shows a time-varied waveform 91 of an exciting current fed into the exciting coil 12 and results 92 of Fourier transform of vibrations detected by the vibration sensor 81.

If the test pile 21 is vibrated by the exciting current whose frequency is varied with time as illustrated, the test pile 21 vibrates at a maximum amplitude the moment at which the frequency coincides with the resonant frequency of the test pile 21. Thus, it is possible to obtain the resonant frequency of the test pile 21 by determining this frequency by the frequency analyzing unit 82.

Accordingly, even if the length L1 of the test pile 21 is unknown or the resonant frequency calculated from the length L1 and sound propagation velocity V contains an error caused by the influence of the ground or pile driving conditions, it is possible to easily obtain the actual resonant frequency.

While the vibration sensor 81 is mounted on the head of the test pile 21 in this embodiment, vibrations caused in the ground surrounding the test pile 21 may be detected to obtain the same results.

After determining the resonant frequency of the test pile 21 in the aforementioned fashion, a dynamic loading test is conducted by adjusting the mass M of the weight 71 such that the resonant frequency of the magnetostrictive vibrator 10 carrying the weight 71 matches the resonant frequency of the test pile 21 and vibrating the test pile 21 again at this resonant frequency.

Seventh Embodiment

A dynamic loading test method according to a seventh embodiment of the invention is now described.

The power supply unit 24 supplies an electric current into the exciting coil 12 in accordance with a control signal fed from the control unit 23 while varying the amplitude of the exciting current such that it increases with time. Vibrations consequently occurring in the magnetostrictive vibrator 10 are transmitted to the test pile 21 via the joint mechanism 22, causing the test pile 21 to vibrate with an amplitude increasing with time.

While the amplitude of vibrations produced in the test pile 21 increases with time if the amplitude of the exciting current is increased with time in this fashion, the state of vibration transmission on a contact surface of the test pile 21 varies when a strain produced in soil adjacent to the contact surface of the test pile 21 exceeds, in the course of time, the limit below which the soil can be treated as an elastic body.

Figure 10:
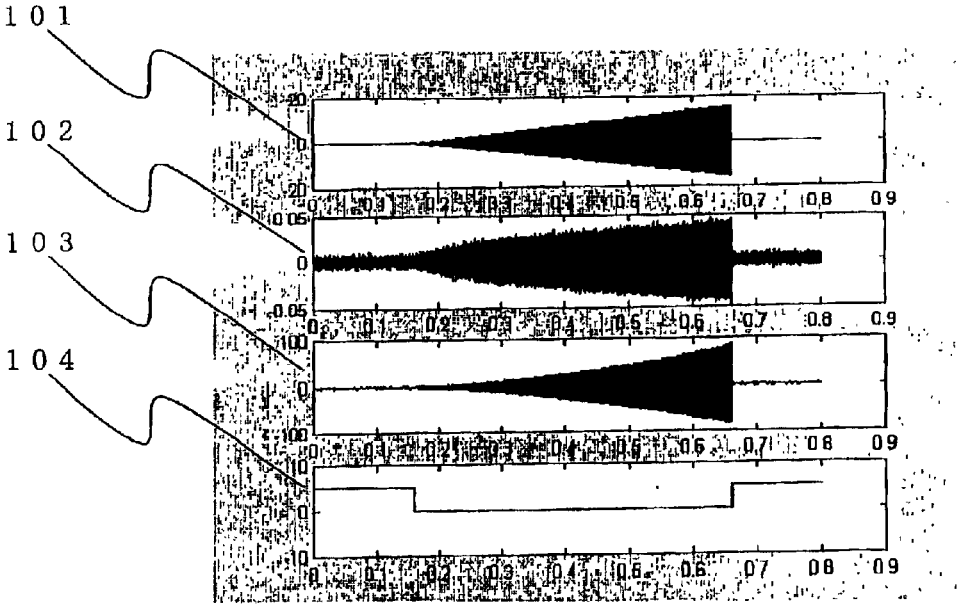
FIG. 10 is a diagram illustrating operation performed in a dynamic loading test method according to a seventh embodiment of the invention.
Figure 11:
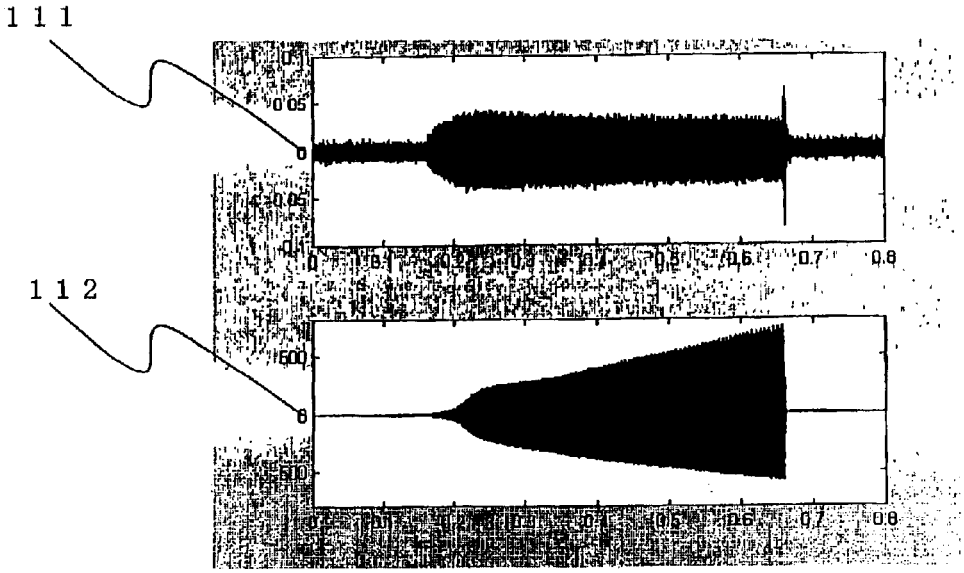
FIG. 11 is a diagram illustrating operation performed in the dynamic loading test method according to the seventh embodiment of the invention.

FIGS. 10 and 11 are diagrams illustrating operation performed in the dynamic loading test method of this embodiment. Specifically, FIG. 10 shows waveform 101 of an electric current fed from the power supply unit 24, output waveform 102 of a vibration sensor detected at a fixed point on the ground around the test pile 21, output waveform 103 of a vibration sensor detected at a fixed point on the head of the test pile 21 and waveform 104 of a sweep time control signal observed under conditions under which the soil adjacent to the contact surface of the test pile 21 acts as an elastic body. FIG. 11 shows output waveform 111 of the vibration sensor detected at the fixed point on the ground around the test pile 21 and output waveform 112 of the vibration sensor detected at the fixed point on the head of the test pile 21 observed under conditions under which the strain produced in the soil adjacent to the contact surface of the test pile 21 has exceeded the limit below which the soil can be treated as an elastic body and the state of vibration transmission on the contact surface has varied.

If vibrations detected by the vibration sensor while the amplitude of the exciting current is increased with time are observed using as a trigger signal the sweep time control signal 104 for controlling the point in time at which the amplitude of the exciting current is changed, for example, it can be seen that both the waveform 103 of vibrations of the head of the test pile 21 and the waveform 102 of vibrations of the ground increase with time and their amplitude has an approximately proportional relationship with that of the waveform 101 of the exciting current as shown in FIG. 10 when the amplitude is relatively small and the soil adjacent to the contact surface of the test pile 21 acts as an elastic body. While the amplitude of the waveform 103 of the vibrations of the head of the test pile 21 increases as shown in FIG. 11 if the exciting current is varied such that its amplitude further increases, a change occurs in the aforementioned proportional relationship of the waveform 102 of the vibrations of the ground at a point in time when the soil adjacent to the contact surface of the test pile 21 exceeds the limit below which the soil can be treated as an elastic body and the state of vibration transmission on the contact surface varies. Since the point of this change is detected as a change in the envelope of the amplitude or as a change in phase, the amount of strain at which the state of vibration transmission varies, or a limit value below which the soil can be treated as an elastic body, can be easily obtained. Accordingly, it is possible to determine the maximum stationary peripheral surface friction force of the test pile 21 and estimate the bearing capacity of the test pile 21 from this value.

It is therefore possible to conduct a loading test of the test pile 21 with good controllability and ease at low cost and estimate the bearing capacity of the test pile 21 with high reliability without the need for complicated analytical treatment.

Eighth Embodiment

A dynamic loading test method according to an eighth embodiment of the invention is now described.

Figure 12:
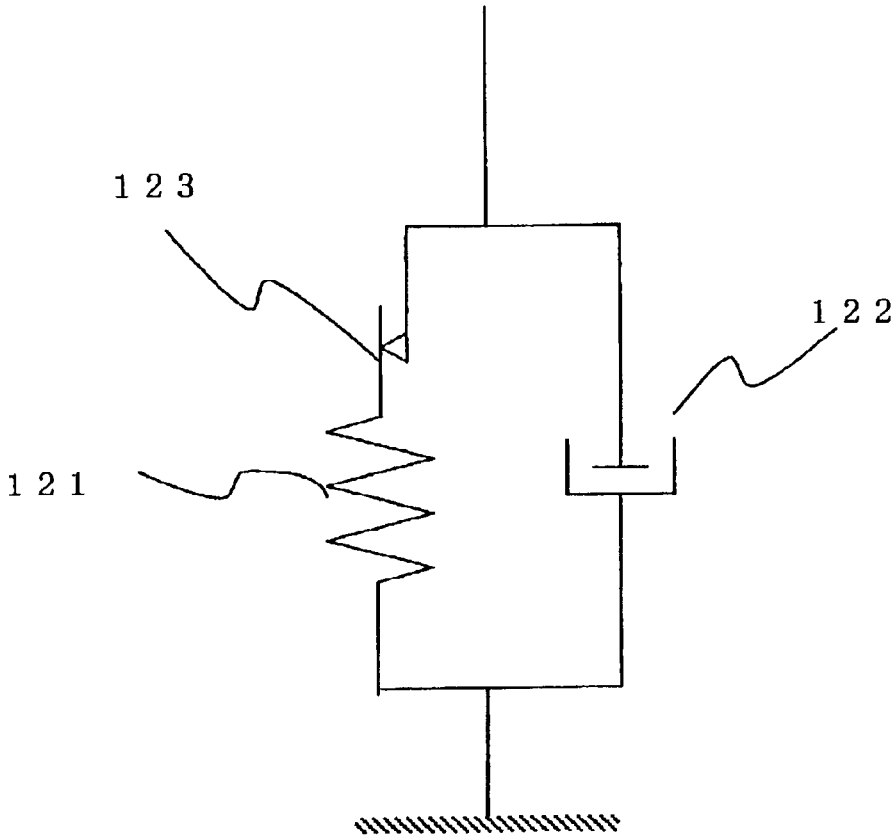
FIG. 12 is a diagram explaining a theoretical model applied to a contact surface between a peripheral surface of a pile and the ground in an eighth embodiment of the invention.

The power supply unit 24 supplies an electric current into the exciting coil 12 in accordance with a control signal fed from the control unit 23, and vibrations consequently occurring in the magnetostrictive vibrator 10 are transmitted to the test pile 21 via the joint mechanism 22, causing the test pile 21 to vibrate. Vibrations thus produced in the test pile 21 are transmitted to the surrounding soil through the peripheral surface of the test pile 21. A contact surface between the peripheral surface of the test pile 21 and the soil is represented by a theoretical model shown in FIG. 12 including a component 121 which is proportional to displacement, a component 122 which is proportional to velocity and a component 123 representing elasticity/plasticity.

In this embodiment, the individual parameters of the aforementioned theoretical model are estimated and the bearing capacity of the test pile 21 is estimated from these parameters, as will be described in the following with reference to FIG. 13.

Figure 13:
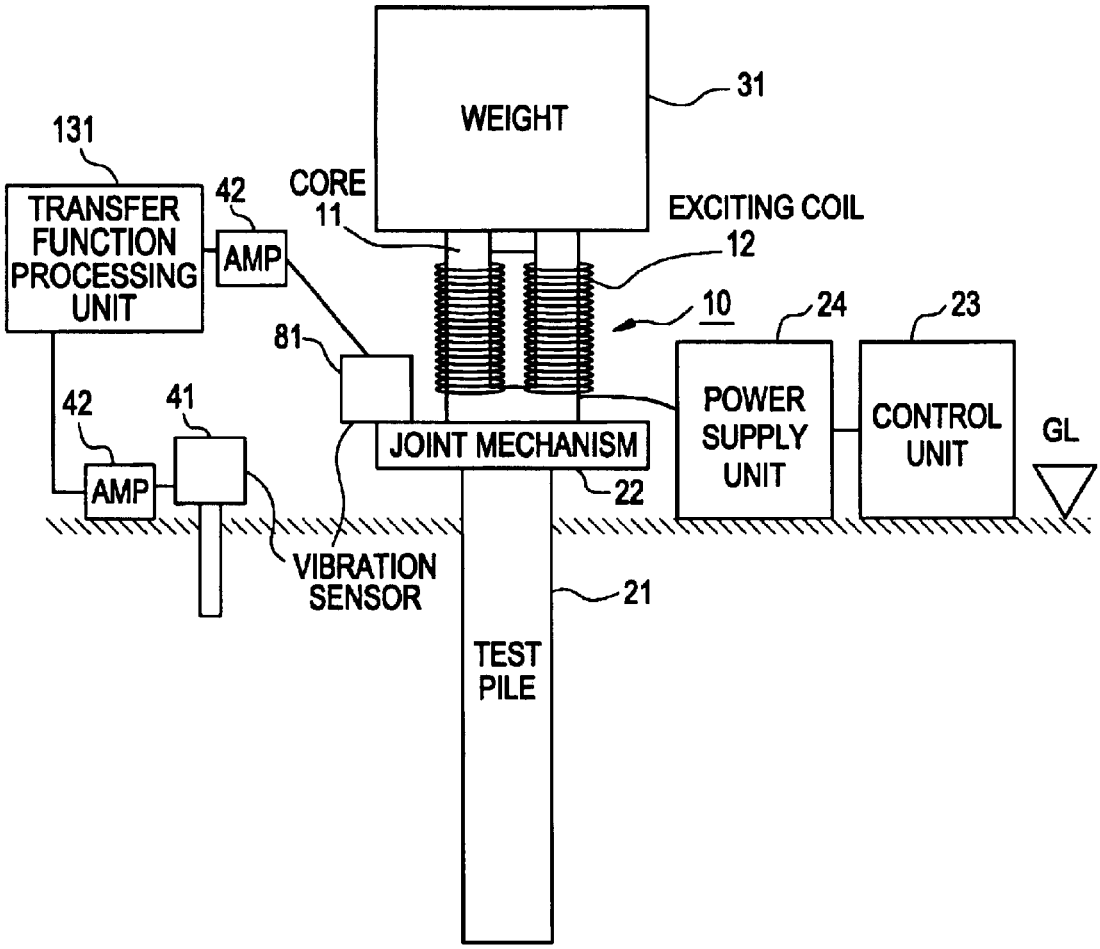
FIG. 13 is a diagram illustrating a dynamic loading test method according to the eighth embodiment of the invention.

As shown in FIG. 13, the power supply unit 24 supplies the electric current into the exciting coil 12 in accordance with the control signal fed from the control unit 23 while varying the frequency of the exciting current with time. As a result, vibrations occur in the magnetostrictive vibrator 10 due to its distortion, and the vibrations are transmitted to the head of the test pile 21 via the joint mechanism 22, causing vibrations in the test pile 21. The vibrations transmitted to the test pile 21 are detected by a vibration sensor 81 mounted on the head of the test pile 21. On the other hand, the vibrations transmitted to the test pile 21 further propagate from its peripheral surface into the surrounding ground and are detected by a vibration sensor 41 mounted on the ground. The individual sensors 41, 81 convert the detected vibrations into electric signals, which are input into respective amplifiers 42. After appropriate amplification by the amplifiers 42, the signals are individually input into a transfer function processing unit 131.

The transfer function processing unit 131 calculates a transfer function from the two input signals. The relationship between the phases or amplitudes of the two input signals at individual frequencies is determined from the transfer function thus calculated. Then, the individual parameters of the theoretical model can be estimated from this relationship.

It is therefore possible to easily estimate the individual parameters of the theoretical model without the need for complicated analysis and estimate the bearing capacity of the test pile 21 based on these parameters.

Also, since the frequency of the exciting current is made variable with time, it is possible to give vibratory energy to the test pile 21 and the ground over a wide frequency range and obtain responses at individual frequencies. This enables efficient and accurate observation and highly reliable estimation of the parameters of the theoretical model.

It is to be noted that the reliability of estimation of the parameters of the theoretical model is further increased if a plurality of vibration sensors are installed underground or on the ground, or both underground and on the ground, and transfer functions between the individual sensors are calculated.

Ninth Embodiment

Figure 14:
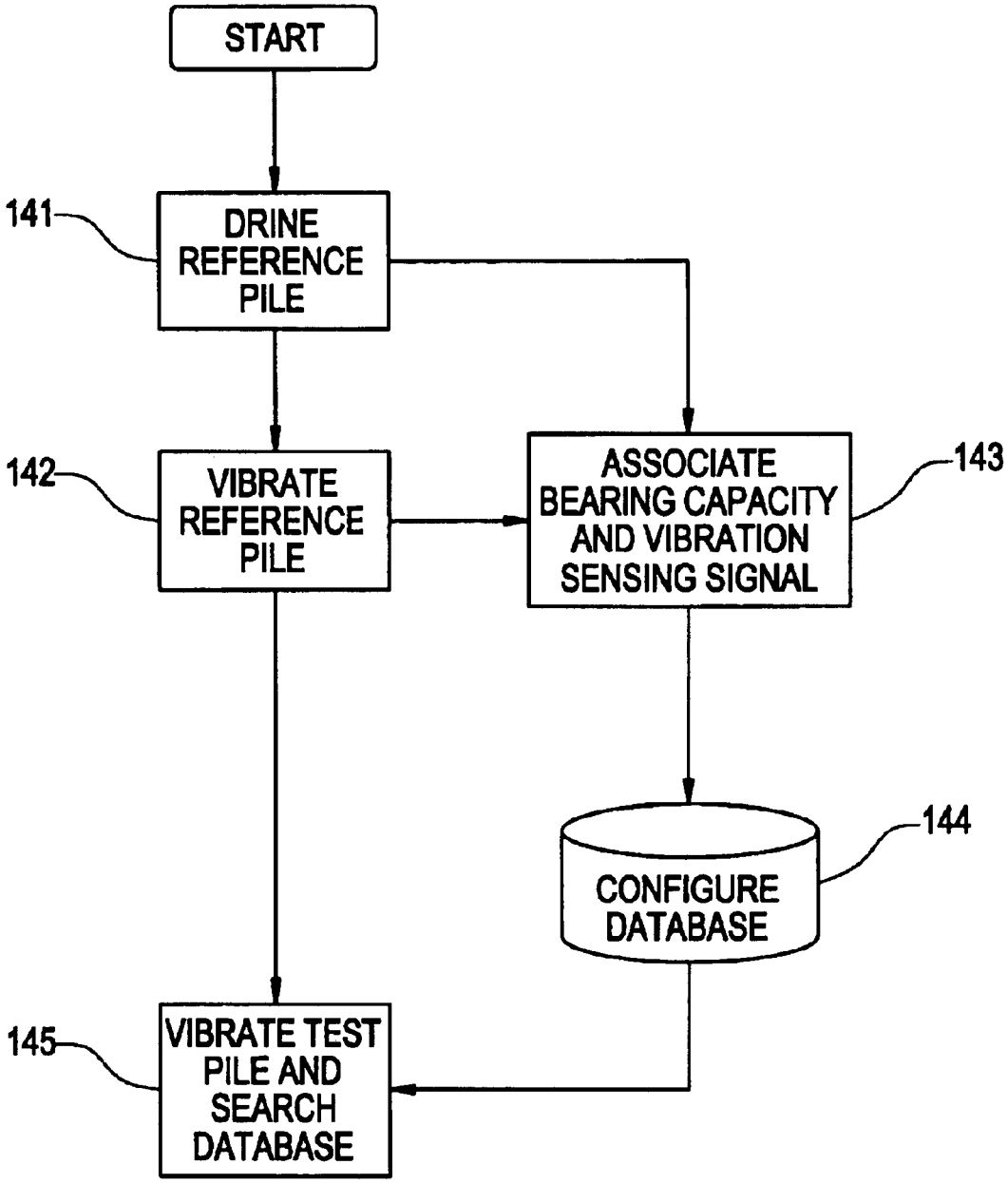
FIG. 14 is a diagram illustrating operation performed in a dynamic loading test method according to a ninth embodiment of the invention.

A dynamic loading test method according to a ninth embodiment of the invention is now described with reference to a flowchart of FIG. 14.

Figure 15:
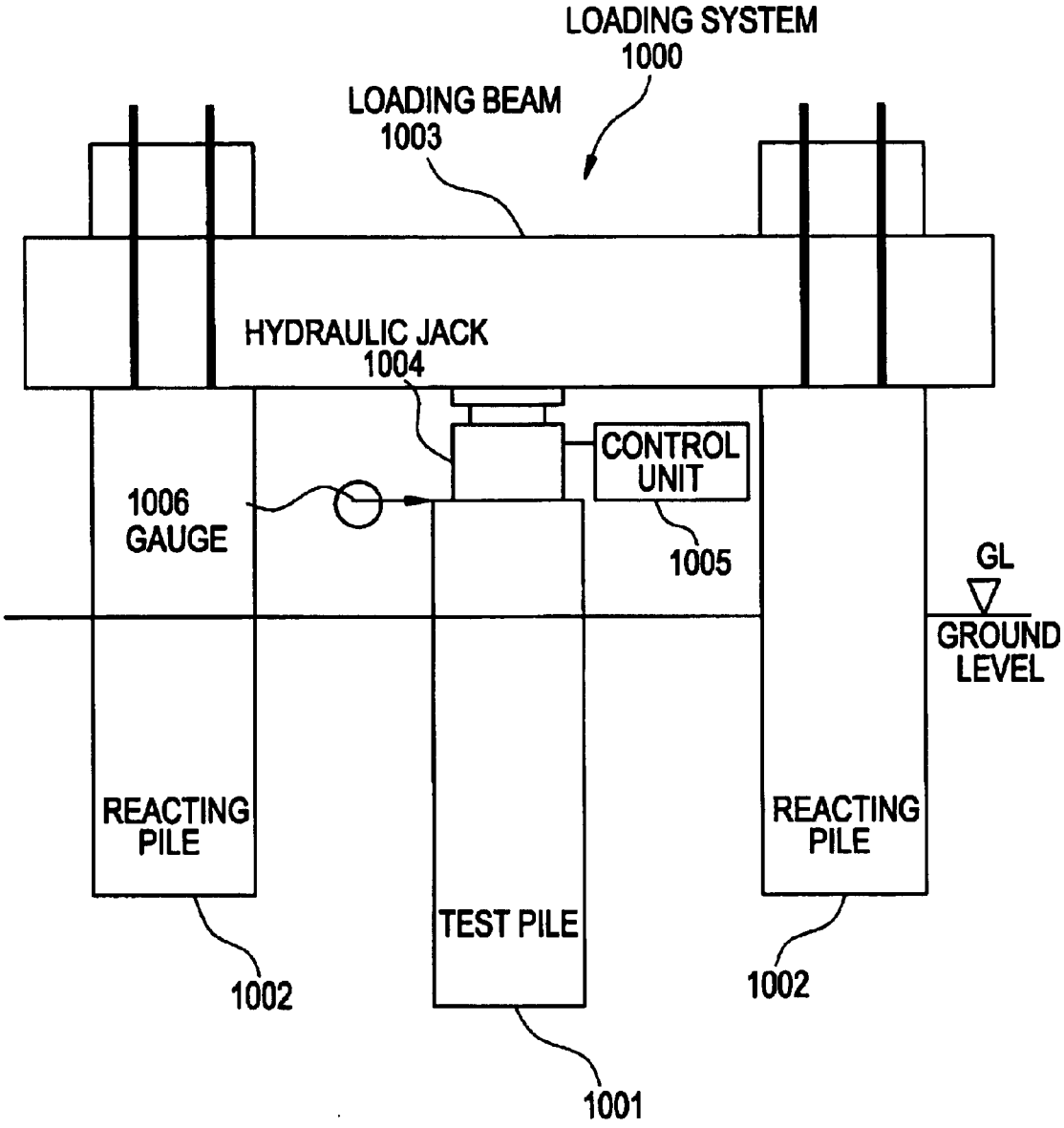
FIG. 15 PRIOR ART
FIG. 15 is a diagram illustrating a conventional stationary loading system.
Figure 16:
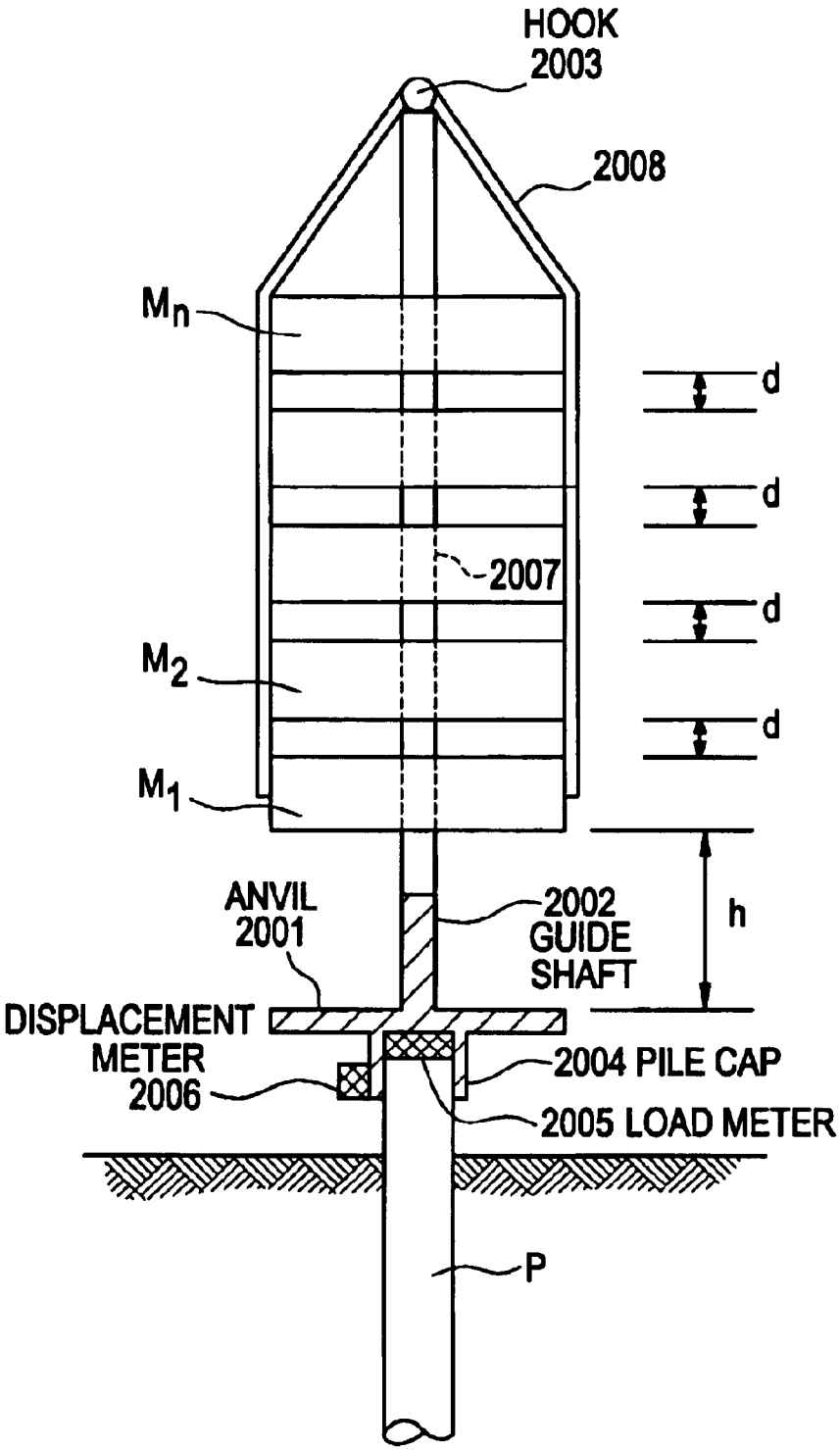
FIG. 16 PRIOR ART
FIG. 16 is a diagram illustrating another conventional dynamic loading system.

In a first step 141, a reference pile is driven into the ground in the vicinity of the test pile 21 whose bearing capacity is to be estimated, and the bearing capacity of this reference pile is determined by the earlier-mentioned conventional stationary loading test method using the stationary loading system 1000 shown in FIG. 15. Next, in a second step 142, the reference pile is vibrated by using the dynamic loading system of the earlier-described first or second embodiment and vibrations produced in the ground surrounding the reference pile are detected. In a third step 143, the bearing capacity of the reference pile obtained in the first step 141 and a vibration sensing signal obtained in the second step 142 are memorized together with information on their mutual relationship to configure a database 144 in which the bearing capacity and the vibration sensing signal are related to each other. Then, in a fourth step 145, the test pile 21 to be subjected to the dynamic loading test method is vibrated by the same method as applied to the reference pile, vibrations produced in the ground are detected, a bearing capacity corresponding to a resultant sensing signal is extracted by searching through the database 144, and the bearing capacity thus extracted is assumed to be the bearing capacity of the test pile 21.

If the reference pile and the test pile 21 to be tested are driven into the ground close to each other as described above, similar responses are expected to be observed because generally similar underground structures including stratum formation and groundwater conditions should exist at nearby points on the ground. Therefore, if the bearing capacity of the reference pile is predetermined by the stationary loading test method using the stationary loading system 1000 shown in FIG. 15, for example, and the bearing capacity of the test pile 21 is estimated based on the bearing capacity of the reference pile as described above, it is possible to estimate the bearing capacity of the test pile 21 with ease and high reliability even when a complicated stratum formation or a nonlinear factor of the ground is influential.

Although the test pile 21 is vibrated by using the magnetostrictive vibrator 10 in the foregoing first to ninth embodiments, any other vibration source may be used to obtain the same effect provided that the vibration source is of a type of which vibration frequency and amplitude can be controlled in a desired manner.

What is claimed is:

1. A dynamic loading system for a pile, said dynamic loading system comprising:

a magnetostrictive vibrator including a magnetostrictive element which becomes strained when placed in a magnetic field and an exciting coil for producing the magnetic field in the magnetostrictive element;

a joint mechanism for connecting the magnetostrictive vibrator to the head of the pile;

a power supply unit for feeding an electric current into the magnetostrictive vibrator; and a control unit for controlling the frequency and amplitude of the electric current;

wherein the pile is vibrated at or about its resonant frequency by a strain occurring in the magnetostrictive vibrator.

2. The dynamic loading system according to claim 1 further comprising a weight of a specific mass which is supported by the magnetostrictive vibrator, wherein the resonant frequency of the magnetostrictive vibrator is determined by the specific mass of the weight and the stiffness of the magnetostrictive vibrator.

3. A system as claimed in claim 2, wherein the resonant frequency of the magnetostrictive vibrator is approximately equal to the resonant frequency of the pile.

4. A dynamic loading method for a pile, said dynamic loading method comprising:

feeding an electric current into an exciting coil of a magnetostrictive vibrator which is connected to the head of the pile; and transmitting a strain occurring in the magnetostrictive vibrator due to a magnetic field to the pile in the form of vibrations to thereby vibrate the pile, wherein the magnetostrictive vibrator supports a weight of a specific mass in such a manner that the resonant frequency of the magnetostrictive vibrator which is determined by the mass of the weight and the stiffness of the magnetostrictive vibrator becomes generally equal to the resonant frequency of the pile, and the pile is vibrated at its resonant frequency or at a frequency close to its resonant frequency.

5. The dynamic loading method according to claim 4, wherein, before vibrating the pile at its resonant frequency or at a frequency close to its resonant frequency, the pile is vibrated by feeding an electric current whose frequency varies with time into the exciting coil of the magnetostrictive vibrator, vibrations produced in the ground around the pile or in the pile itself are observed, and the resonant frequency of the pile is determined from the frequency of the electric current at which the amplitude of the vibrations is maximized.

6. A dynamic loading test method for a pile, said dynamic loading test method comprising:

feeding an electric current into an exciting coil of a magnetostrictive vibrator which is connected to the head of the pile;

vibrating the pile by transmitting a strain occurring in the magnetostrictive vibrator due to a magnetic field to the pile in the form of vibrations;

detecting vibrations produced in the ground around the pile, and estimating the bearing capacity of the piles wherein the magnetostrictive vibrator sun pots a weight of a specific mass in such a manner that the resonant frequency of the magnetostrictive vibrator which is determined by the mass of the weight and the stiffness of the magnetostrictive vibrator becomes generally equal to the resonant frequency of the pile, and the pile is vibrated at its resonant frequency or at a frequency close to its resonant frequency.

7. The dynamic loading test method according to claim 6, wherein the pile is vibrated by feeding an electric current of a specific frequency and amplitude into the exciting coil of the magnetostrictive vibrator, the vibrations produced in the ground around the pile are detected by a vibration sensor, and maximum stationary peripheral surface friction force of the pile is calculated from the amplitude the detected vibrations.

8. The dynamic loading test method according to claim 6, wherein the pile is vibrated by feeding an electric current whose amplitude varies with time into the exciting coil of the magnetostrictive vibrator, variations in the amplitude of the vibrations produced in the ground around the pile are observed by a vibration sensor, and maximum stationary peripheral surface friction force of the pile is calculated.

9. A dynamic loading test method for a pile, said dynamic loading test method comprising:

feeding an electric current into an exciting coil of a magnetostrictive vibrator which is connected to the head of the pile;

vibrating the pile by transmitting a strain occurring in the magnetostrictive vibrator due to a magnetic field to the pile in the form of vibrations;

detecting vibrations produced in the ground around the pile; and estimating the bearing capacity of the pile, wherein the pile is vibrated by feeding an electric current into the exciting coil of the magnetostrictive vibrator, the electric current fed into the exciting coil is controlled such that the amplitude of the vibrations produced in the ground around the pile matches a preset target value, and a maximum stationary peripheral surface friction force of the pile is calculated from the value of the controlled electric current.

10. A dynamic loading test method for a pile, said dynamic loading test method comprising:

feeding an electric current whose frequency varies with time into an exciting coil of a magnetostrictive vibrator which is connected to the head of the pile;

vibrating the pile by transmitting a strain occurring in the magnetostrictive vibrator due to a magnetic field to the pile in the form of vibrations;

detecting vibrations produced in the pile itself and in the ground around the pile by respective vibration sensors, and estimating the bearing capacity of the pile by calculating a transfer function from sensing signals of the respective vibration sensors.

11. A dynamic loading test method for a pile, said dynamic loading test method comprising:

a first step of determining the bearing capacity of a reference pile driven into the ground in the vicinity of the pile by a stationary loading test method;

a second step of feeding an electric current into an exciting coil of a magnetostrictive vibrator which is connected to the head of the reference pile, vibrating the reference pile by transmitting a strain occurring in the magnetostrictive vibrator due to a magnetic field to the reference pile in the form of vibrations and detecting vibrations produced in the ground around the reference pile;

a third step of memorizing the bearing capacity of the reference pile obtained in said first step and a vibration sensing signal obtained in said second step together with information on their mutual relationship;

a fourth step of vibrating the pile in the same way as said second step and detecting vibrations produced in the ground; and a fifth step of estimating the bearing capacity of the pile based on a vibration sensing signal obtained in said fourth step with reference to information memorized in said third step.

* * * * *